United States Patent [19]

Nakajima et al.

[11] Patent Number: 4,493,304

[45] Date of Patent: Jan. 15, 1985

[54] TEMPERATURE MEASURING DEVICE FOR INTERNAL-COMBUSTION ENGINE

[75] Inventors: Tetsuo Nakajima; Hirotaka Kumata, both of Saitama, Japan

[73] Assignee: Honda Giken Kogyo Kabushiki Kaisha, Tokyo, Japan

[21] Appl. No.: 559,605

[22] Filed: Dec. 8, 1983

[30] Foreign Application Priority Data

Dec. 27, 1982 [JP] Japan ..... 57-195636

[51] Int. Cl.[3] ..... F02B 3/00

[52] U.S. Cl. ..... 123/479; 123/494

[58] Field of Search ..... 123/479, 494

[56] References Cited

U.S. PATENT DOCUMENTS 4,274,381 6/1981 Abo ..... 123/479

FOREIGN PATENT DOCUMENTS 54-141926 11/1979 Japan ..... 123/479

55-5433 1/1980 Japan ..... 123/479

57-51922 3/1982 Japan ..... 123/479

*Primary Examiner*—Ronald B. Cox

*Attorney, Agent, or Firm*—Pollock, Vande Sande & Priddy

[57] ABSTRACT

Temperature measuring device for an internal-combustion engine comprising a main engine temperature sensor to measure the temperature of the cooling water, for example, and a secondary or auxiliary temperature sensor disposed near a heat generating element in an electronic engine control unit, as a standby for the main temperature sensor.

When an output of the main temperature sensor happens to fall outside the predetermined normal range, the main temperature sensor will be immediately switched to the auxiliary temperature sensor to allow the various phases of engine control to proceed without interruption.

2 Claims, 4 Drawing Figures

TEMPERATURE MEASURING DEVICE FOR INTERNAL-COMBUSTION ENGINE

BACKGROUND OF THE INVENTION (1) Field of the Invention

This invention relates to a temperature measuring device for an internal-combustion engine, and more particularly to a temperature measuring device for an internal-combustion engine, which device is provided not only with a main temperature sensor intended to measure the temperature of the cooling water, for example, chosen as representing the temperature of the internal-combustion engine but also with a secondary or auxiliary temperature sensor intended as a standby for the aforementioned main temperature sensor.

(2) Description of the Prior Art

The temperature of the internal-combustion engine, particularly when the engine is started or while it is being warmed up, is utilized as a parameter for:

(1) control of the duration of fuel injection in an electronic fuel injection device, (2) adjustment of the timing for ignition, (3) control of exhaust gas recirculation, and (4) control of an opening angle of a throttle valve and/or choke valve in an electronically regulated carburetor.

The temperature of the cooling water for the internal-combustion engine is generally adopted as representing the temperature of the internal-combustion engine.

When the main temperature sensor serving to measure the temperature of the cooling water goes out of order and/or the electric wire interconnecting the main temperature sensor and the electronic control unit is broken or short-circuited, therefore, collection of data on engine temperature is interrupted. Particularly when this mishap arises while the ambient temperature is low, there ensues a problem that the engine will be started or warmed up with difficulty.

SUMMARY OF THE INVENTION

This invention has been perfected for the purpose of giving a solution to the problem described above. It is aimed at providing a temperature measuring device for an internal-combustion engine, which is additionally provided with an auxiliary temperature sensor capable of immediately taking the place of a main temperature sensor serving to measure the engine temperature in case the main temperature sensor develops trouble.

To accomplish the object described above, this invention contemplates disposing, near a heat generating element within an electronic control unit (such as, for example, a power transistor), an auxiliary temperature sensor adapted so that when the main engine temperature sensor inherent in the internal-combustion engine happens provide an output falling within an abnormal range, this main temperature sensor wll be immediately switched to the auxiliary temperature sensor to allow the various phases of engine control to proceed without interruption.

DETAILED DESCRIPTION OF THE PREFERRED EMBODIMENT

Now, the present invention will be described below with reference to the accompanying drawings.

Figure 1:
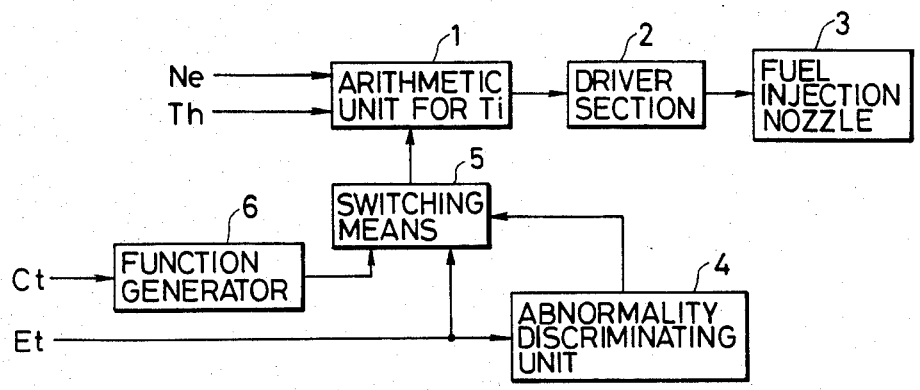
FIG. 1 is a circuit block diagram illustrating a typical embodiment of this invention in electronic fuel control.

FIG. 1 is a block diagram illustrating an embodiment of this invention as applied to control of the fuel injection pulse duration in an internal-combustion engine.

An arithmetic unit 1 computes (or reads out of a memory) a basic fuel injection pulse duration signal based on the number of engine rotations Ne, and the opening angle of a throttle valve Th, as parameters, effects compensation (multiplication compensation or addition compensation) on that signal based on the engine temperature Et, i.e. the output of a main temperature sensor, and then feeds out a temperature compensated fuel injection pulse duration signal Ti to an output driver section 2. The output driver section 2 keeps open a fuel injection nozzle 3 for a duration designated by the aforementioned fuel injection pulse duration signal Ti and effects supply of fuel to the internal-combustion engine (not shown).

The procedure of control described above is well known very well to persons of ordinary skill in the art.

In accordance with the present invention, an abnormality discriminating unit 4 monitors the detected engine temperature Et to determine whether or not the temperature sensing operation is proceeding normally. Specifically, this monitoring determines whether or not a given value of the engine temperature Et falls within a prescribed range, i.e. confirming that this value is smaller than the upper limit and larger than the lower limit respectively of the aforementioned range.

In accordance with the outcome of this monitoring, either the engine temperature Et or the case temperature Ct (the output of an auxiliary temperature sensor) is switched by a switching means 5 and fed to the arithmetic unit 1 for use in compensating Ti.

When the engine temperature Et output of the main engine temperature sensor is found to be in the normal range, the aforementioned compensation of Ti is effected by the value of the engine temperature Et detected at the moment by the main engine temperature sensor. When the value Et deviates from the normal range, however, the aforementioned compensation is effected in accordance with the output from a function generator 6 feeds out in response to the case temperature Ct fed therein as the input thereto.

Here, the fact that the aforementioned compensation can be also executed based on the case temperature Ct will be described.

Figure 2:
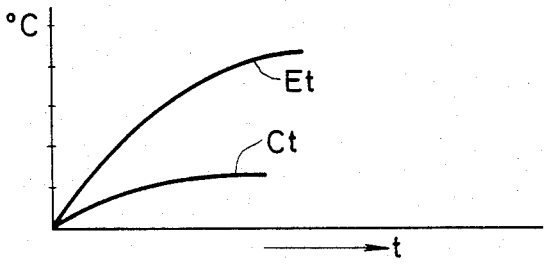
FIG. 2 is a graph illustrating typical changes of engine temperature Et and case temperature Ct relative to time.

FIG. 2 represents one typical process of elevation of the engine temperature Et and the case temperature Ct (against the vertical axis: °C.) as a function of the elapse of time t (the horizontal axis) from the time that the internal-combustion engine is started.

As is clear from this diagram, the engine temperature Et and the case temperature Ct are substantially correlated and their relation can be determined either empirically or through actual measurement.

By causing the function generator 6 to memorize their relation and consequently enabling it to convert the case temperature Ct into the engine temperature Et and feed out the latter temperature as its output, the case temperature Ct provided by the auxiliary temperature sensor can be used in the place of the engine temperature Et output of the main temperature sensor when the sensed engine temperature Et deviates from the normal range. By this arrangement, the internal-combustion engine can be started or warmed up without trouble even when the ambient temperature is low.

Figure 3:
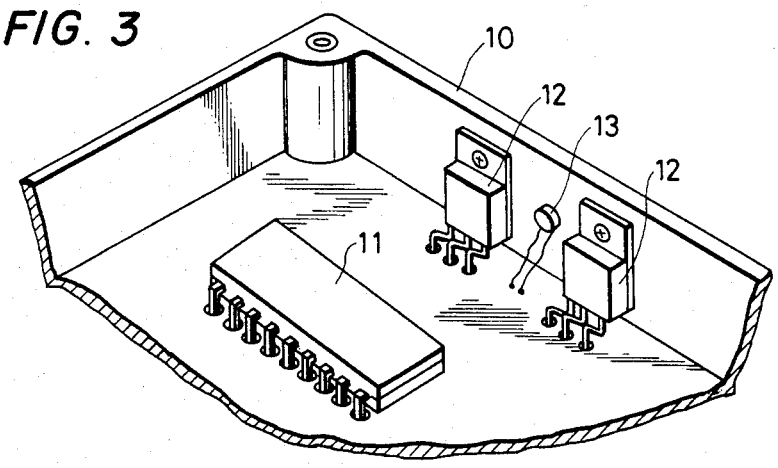
FIG. 3 is a perspective view illustrating an essential part of one working example of this invention.

FIG. 3 is a perspective view illustrating a typical configuration of the sensor for case temperature Ct (namely, the auxiliary temperature sensor).

Inside a case body 10 for an electronic control unit, an IC (integral circuit) 11, a power transistor 12 etc. are accommodated. Since the power transistor 12 generates a large amount of heat, it is generally fixed directly or through the medium of a heat radiating fin to the case body 10 in due consideration of the heat radiating property thereof.

An auxiliary temperature sensor 13 in accordance with this invention is fixed near the power transistor 12. Thus, the auxiliary sensor 13 receives, through conduction, the heat generated by the power transistor 12 and has its temperature elevated with the elapse of time as indicated by the curve Ct in FIG. 2.

By causing the aforementioned rising temperature characteristic of the auxiliary temperature sensor 13 to be memorized by the function generator 6 as compared with that of the main temperature sensor for the engine temperature Et, the auxiliary temperature sensor 13 can serve as a standby in case of an emergency, i.e. when the engine temperature Et deviates from its normal range.

Figure 4:
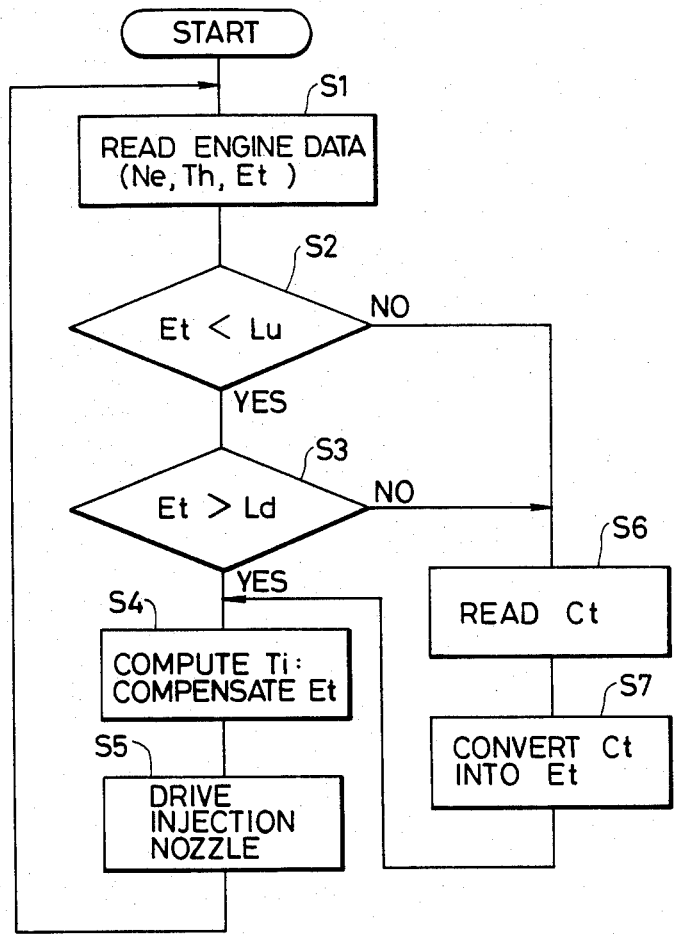
FIG. 4 is a flow chart illustrating this invention as applied to electronic fuel control by the use of a microcomputer.

FIG. 4 is a flow chart illustrating the aforementioned operation of the computation and compensation of the fuel injection pulse duration signal Ti by the use of an electronic computer. The individual steps involved in the operation illustrated in the diagram are as follows.

Step S1—Such engine data as the number of engine rotations Ne, the aperture of throttle valve Th, and the engine temperature Et are read in.

Step S2—The engine temperature Et is checked to determine whether or not that temperature is lower than the upper limit Lu.

Step S3—The engine temperature Et is checked to determine whether or not that temperature is higher than the lower limit Ld.

Step S4—Step S2 and Step S3 both give positive answers when the operation of the main engine temperature sensor is normal. In this case, the processing advances to Step S4. In this step, the computation of the basic fuel injection pulse duration signal (to be read out of the memory) and the compensation thereof by the engine temperature Et are carried out.

Step S5—In accordance with the fuel injection pulse duration signal obtained in the preceding step S4, the output driver section 2 is actuated to open the valve for the injection nozzle 2 and effect fuel injection.

Step S6—Step S2 and Step S3 both give negative answers when the operation of the main engine temperature sensor is not normal. In this case, the processing advances to Step 6 and the case temperature Ct is read in. Naturally, this reading in of the case temperature Ct may be effected in Step S1 instead.

Step S7—The conversion of the case temperature Ct to the engine temperature Et is effected in accordance with the relation between the Et and the Ct previously determined and meorized (such as by reference to a table).

In other words, when the engine temperature Et is in its normal range of measurement, the processing circulates through the steps S1-S2-S3-S4-S5-S1, and consequently the fuel injection pulse duration signal is compensated by the output of the main engine temperature sensor.

On the other hand, when the engine temperature Et deviates from its normal range of measurement, the process circulates through the steps S1-S2-S3-S6-S7-S4-S5-S1, and consequently the fuel injection pulse duration signal is compensated by the output of the auxiliary temperature sensor.

In accordance with the present invention, as is clear from the description given above, when the engine temperature sensor system goes out of order, the temperature compensation in the system is immediately switched to that by the auxiliary temperature sensor. Thus, the internal-combustion engine can be started or warmed up without entailing any interruption.

Further, because the auxiliary temperature sensor of this invention is fixed to the case 10 for the electronic control unit, a short lead wire suffices for the sensor 13 and the possibility of this lead wire being broken or short-circulated because of external impacts is very remote. Thus, it can be relied on as a perfect standby.

The foregoing embodiment has been described as involving the use of a power transistor in the electronic control unit as a member capable of simulating the temperature elevation of the internal-combustion engine. It is, of course, possible to incorporate, instead, an additional heat generating member (such as, for example, an electric resistance heat generator) for exclusive use in the auxiliary temperature sensor. It will be readily understood by those skilled in the art that although the invention has been described as applied only to the compensation of the fuel injection pulse duration signal, it is effectively applicable similarly to the adjustment of ignition timing or to the control of EGR (Exhaust Gas Recirculation) mentioned in the early part of this specification.

What is claimed is:

1. A temperature measuring device for an internal-combustion engine, comprising a main temperature sensor operative to measure the temperature of a member such as the cooling water which represents temperature of said internal-combustion engine, means to measure the engine data such as an engine rotation number and an opening angle of a throttle valve, an electronic control unit adapted to receive engine data resulting from said measurement, compute an engine control signal based on said engine data, and feed out the outcome of said computation, an auxiliary temperature sensor disposed near a heat generating member of said electronic control unit and adapted to be heated by said heat generating member, means for discriminating whether or not the output from said main temperature sensor falls within a prescribed range, and means operative, according to the outcome of the judgment by said discriminating means, to select the output of said main temperature sensor when said output of said main temperature sensor falls in said prescribed range or the output of said auxiliary temperature sensor when said output of said main temperature sensor deviates from said prescribed range and feed said selected output in the form of a temperature signal for control of said internal-combustion engine.

2. A temperature measuring device according to claim 1, which further comprises a function generator capable of converting the output of said auxiliary temperature sensor into a corresponding output of said main temperature sensor.

* * * * *